US009063454B2

(12) United States Patent
Itani

(10) Patent No.: US 9,063,454 B2
(45) Date of Patent: Jun. 23, 2015

(54) IMAGE FORMING APPARATUS

(71) Applicant: KYOCERA Document Solutions Inc., Osaka (JP)

(72) Inventor: Hiroka Itani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 22 days.

(21) Appl. No.: 14/026,255

(22) Filed: Sep. 13, 2013

(65) Prior Publication Data

US 2014/0079419 A1 Mar. 20, 2014

(30) Foreign Application Priority Data

Sep. 18, 2012 (JP) ..... 2012-204725

(51) Int. Cl.
*G03G 15/02* (2006.01)
*G03G 21/00* (2006.01)
*G03G 21/06* (2006.01)

(52) U.S. Cl.
CPC ..... *G03G 15/0266* (2013.01); *G03G 21/06* (2013.01)

(58) Field of Classification Search
USPC ..... 399/50, 128, 314, 315
See application file for complete search history.

(56) References Cited

U.S. PATENT DOCUMENTS

| | | | | |
|---|---|---|---|---|
| 5,701,551 | A * | 12/1997 | Honda et al. | 399/50 |
| 6,332,064 | B1 * | 12/2001 | Sato et al. | 399/50 |
| 2005/0260006 | A1 * | 11/2005 | Matsuda et al. | 399/50 |
| 2011/0299866 | A1 | 12/2011 | Kadota et al. | |

FOREIGN PATENT DOCUMENTS

| | | | |
|---|---|---|---|
| JP | 61-38969 | A | 2/1986 |
| JP | 63-19867 | U | 2/1988 |
| JP | 05-289458 | A | 11/1993 |
| JP | 07-152294 | A | 6/1995 |
| JP | 07-168405 | A | 7/1995 |
| JP | 09-050216 | A | 2/1997 |
| JP | 2000-250370 | A | 9/2000 |
| JP | 2003-140526 | A | 5/2003 |
| JP | 2009-122320 | A | 6/2009 |
| JP | 2010-204322 | A | 9/2010 |
| JP | 2012-014145 | | 1/2012 |

OTHER PUBLICATIONS

Notice of Rejection mailed by Japan Patent Office on Sep. 16, 2014 in the corresponding Japanese patent application No. 2012-204725.

* cited by examiner

*Primary Examiner* — David Gray
*Assistant Examiner* — Michael Harrison
(74) *Attorney, Agent, or Firm* — Knobbe, Martens, Olson & Bear LLP

(57) ABSTRACT

An image forming apparatus includes an image forming unit, a charging bias application section, a static eliminating bias application section, and a control section. In the case where the image forming unit causes an image carrier to be rotated without forming an electrostatic latent image on the image carrier, the control section performs a bias control to allow the charging bias application section to apply to a charging section a smaller charging bias than used in forming a toner image and allow the static eliminating bias application section to apply to a static eliminating section a smaller static eliminating bias than used in forming the toner image. The control section performs the bias control to increase respective values of the charging bias and the static eliminating bias every one revolution of the image carrier until the charging bias and the static eliminating bias in forming the toner image are reached.

4 Claims, 5 Drawing Sheets

Fig.3

| | FIRST REVOLUTION OF DRUM | SECOND REVOLUTION OF DRUM | THIRD REVOLUTION OF DRUM |
|---|---|---|---|
| AMOUNT OF STATIC ELIMINATING LIGHT | 50% REDUCTION | 30% REDUCTION | NORMAL |
| CHARGING BIAS | 500 V REDUCTION | 300 V REDUCTION | NORMAL |

Fig.5

| NUMBER OF PRINTED PAPER SHEETS (K) | 0 | 50 | 100 | 150 | 200 | 220 | 230 |
|---|---|---|---|---|---|---|---|
| COMPARATIVE EXAMPLE 1 (CHARGING ON, STATIC ELIMINATION ON) | ○ | ○ | ○ | ○ | ○ | × | — |
| COMPARATIVE EXAMPLE 2 (WEAK CHARGING ON, STATIC ELIMINATION ON) | ○ | ○ | ○ | ○ | ○ | ○ | × |
| EXAMPLE (WEAK CHARGING ON, WEAK STATIC ELIMINATION ON) | ○ | ○ | ○ | ○ | ○ | ○ | ○ |

IMAGE FORMING APPARATUS

INCORPORATION BY REFERENCE

This application claims priority to Japanese Patent Application No. 2012-204725 filed on Sep. 18, 2012, the entire contents of which are incorporated by reference herein.

BACKGROUND

The present disclosure relates to image forming apparatuses including a photosensitive drum as an image carrier.

There is a type of image forming apparatus which includes a plurality of photosensitive drums associated with respective different color toners. This type of image forming apparatus has, for example, a structure employing the tandem method. In the image forming apparatus employing the tandem method, even when, for example, only a black toner is used to form an image on a paper sheet serving as a sheet material for image transfer, not only the photosensitive drum associated with the black toner but also the photosensitive drums associated with cyan, magenta, and yellow toners are rotated. In this case, the image forming apparatus does not charge the surfaces of the photosensitive drums associated with the cyan, magenta, and yellow toners (i.e., the photosensitive drums for color printing), so that the performance of these photosensitive drums will degrade. Then, the image forming apparatus has to repeat a few minutes of charging and a few minutes of static elimination in order to recover the charging performance of the photosensitive drums. This presents a problem of failure to form a color image on the next paper sheet just after the formation of a black-and-white image on the previous paper sheet. In addition, when charging the surfaces of the photosensitive drums, the image forming apparatus may cause electric breakdown (leakage) in the photosensitive drums due to inrush current at the instant of application of a charging bias.

As a solution to these problems, an image forming apparatus is proposed in which in forming a black-and-white image on a paper sheet using a black toner, the surfaces of the photosensitive drums for color printing are charged more weakly than during the formation of images on them and the static charge on the surfaces is then eliminated, thus enabling the formation of a color image on the next paper sheet just after the formation of a black-and-white image on the previous paper sheet.

SUMMARY

A technique improved over the aforementioned conventional technique is proposed as one aspect of the present disclosure.

An image forming apparatus according to the one aspect of the present disclosure includes an image forming unit, a charging bias application section, a static eliminating bias application section, and a control section.

The image forming unit includes an image carrier capable of being driven into rotation, a charging section, an exposure section, a developing section, a transfer section, an a static eliminating section.

The charging section is configured to, upon application of a charging bias thereto, charge a surface of the image carrier being driven into rotation.

The exposure section is configured to expose the surface of the image carrier charged by the charging section to light to form an electrostatic latent image on the surface of the image carrier.

The developing section is configured to supply toner to the electrostatic latent image formed on the surface of the image carrier by the exposure section to form a toner image thereon.

The transfer section is configured to transfer the toner image formed by the developing section to a recording medium.

The static eliminating section is configured to, upon application of a static eliminating bias thereto, eliminate static charge of the charged image carrier.

The charging bias application section is configured to apply the charging bias to the charging section.

The static eliminating bias application section is configured to apply the static eliminating bias to the static eliminating section.

The control section is configured to control an operation of the image forming unit. In the case where the image forming unit causes the image carrier to be rotated without forming the electrostatic latent image on the surface of the image carrier, the control section performs a bias control to allow the charging bias application section to apply to the charging section a predetermined charging bias smaller than a charging bias to be applied in forming the electrostatic latent image on the surface of the image carrier and then forming the toner image, allow the static eliminating bias application section to apply to the static eliminating section a predetermined static eliminating bias smaller than a static eliminating bias to be applied in forming the toner image, and allow the charging bias application section and the static eliminating bias application section to increase a value of the charging bias and a value of the static eliminating bias, respectively, every one revolution of the image carrier until the values of the charging bias and the static eliminating bias to be applied in forming the toner image are reached.

BRIEF DESCRIPTION OF THE DRAWINGS

FIG. 3 is a table showing an example of a relationship among the number of revolutions of a photosensitive drum, the amount of static eliminating light, and the charging bias level.

FIG. 5 is a table for illustrating results of a comparative experiment made using a copier of Example and copiers of Comparative Examples 1 and 2.

DETAILED DESCRIPTION

Hereinafter, a description will be given of one embodiment of an image forming apparatus as an aspect of the present disclosure.

Figure 1:
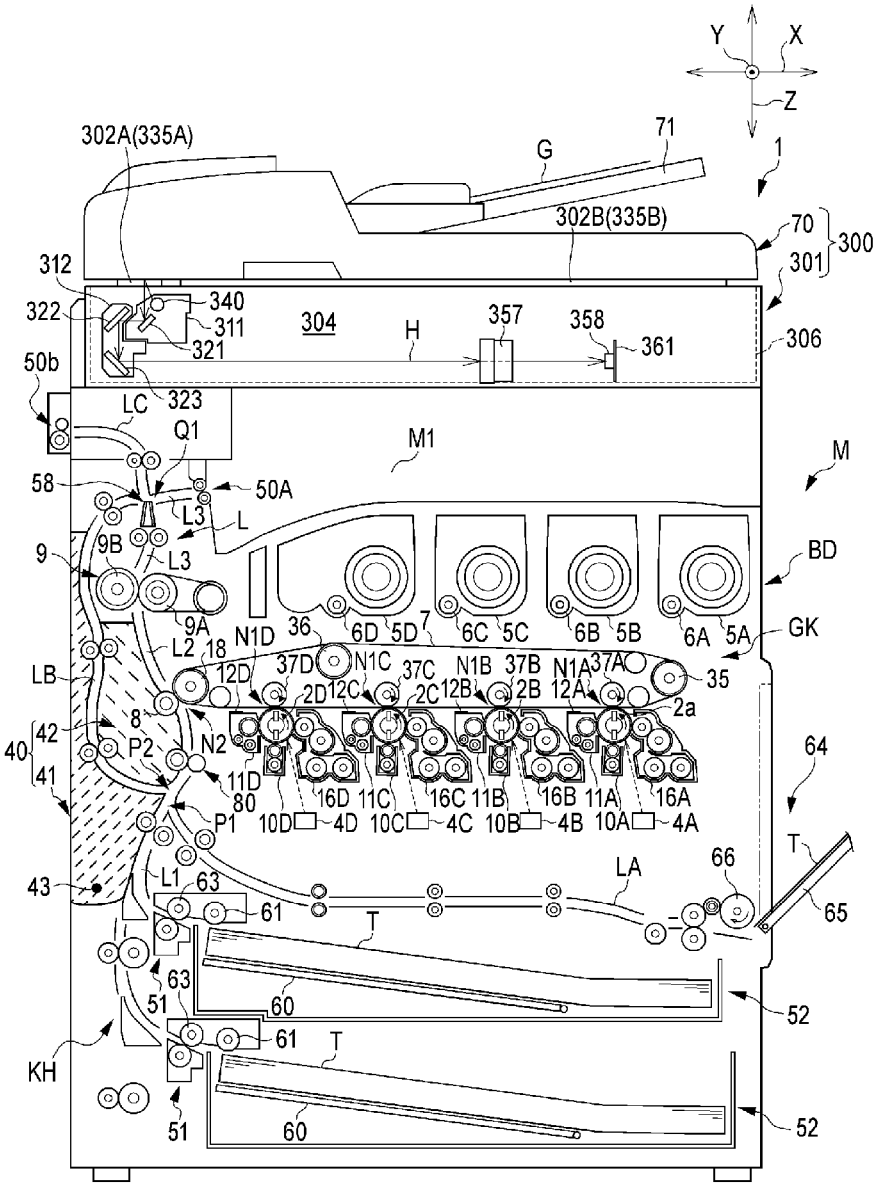
FIG. 1 is a schematic view for illustrating an arrangement of components of a copier according to one embodiment.

With reference first to FIG. 1, a description will be given of the general structure of a copier 1 which is the one embodiment of the image forming apparatus. FIG. 1 is a schematic view for illustrating an arrangement of components of the copier 1 according to the one embodiment.

As shown in FIG. 1, the copier 1 as the image forming apparatus includes: an image reading device 300 disposed on the upper side of the copier 1 in a top-to-bottom direction Z of the copier 1; and an apparatus main unit M disposed on the lower side of the copier 1 in the top-to-bottom direction Z and configured to form a toner image on a paper sheet T serving as a sheet material for image transfer based on image data read by the image reading device 300.

In the following description of the copier 1, a sub-scanning direction X is referred to also as a "right-and-left direction" of the copier 1 and a main scanning direction Y (a direction through the plane of FIG. 1) is referred to also as a "front-to-rear direction" of the copier 1. The top-to-bottom direction Z of the copier 1 is orthogonal to both the sub-scanning direction X and the main scanning direction Y.

First, the image reading device 300 is described.

As shown in FIG. 1, the image reading device 300 includes: a reading section 301 configured to read an image of an original document G; and a document conveying section 70 disposed above the reading section 301 and configured to convey the original document G to the reading section 301.

The reading section 301 includes a housing 306 and first and second reading surfaces 302A and 302B disposed above the housing 306. The reading section 301 contains, in the internal space 304 of the housing 306, a lighting section 340 including a light source, a plurality of mirrors 321, 322, and 323, first and second frames 311 and 312 movable in the sub-scanning direction X, an imaging lens 357, a charge coupled device (CCD) 358 as an example of a reading unit, and a CCD substrate 361 configured to subject image data read by the CCD 358 to predetermined processing and output the image data toward the apparatus main unit M. The lighting section 340 and the first mirror 321 are housed in the first frame 311. The second mirror 322 and the third mirror 323 are housed in the second frame 312.

The document conveying section 70 is connected in an openable and closable manner to the reading section 301 through an unshown connection. The document conveying section 70 includes a document placement portion 71 at the top and a feed roller (not shown) in the interior. The document conveying section 70 has the function of protecting the first reading surface 302A and the second reading surface 302B of the reading section 301.

The first reading surface 302A is a reading surface for use in reading an original document G being conveyed by the document conveying section 70. The first reading surface 302A is formed along the top surface of a first original glass plate 335A on which the original document G is to be conveyed. The first reading surface 302A is located near the left side surface of the housing 206. Hereinafter, this position of the first reading surface 302A shown in FIG. 1 is referred to also as a "first reading position".

The second reading surface 302B is a reading surface for use in reading an original document G without use of the document conveying section 70. The second reading surface 302B is formed along the top surface of a second original glass plate 335B on which the original document G is to be placed. The second reading surface 302B is located to the right of the first reading surface 302A and covers a major portion of the top of the reading section 301 in the sub-scanning direction X.

The first reading surface 302A extends in the main scanning direction Y and the second reading surface 302B extend in both the sub-scanning direction X and the main scanning direction Y.

In reading an original document G to be conveyed by the document conveying section 70, the original document G is placed on the document placement portion 71. The original document G placed on the document placement portion 71 is conveyed to the first reading surface 302A of the reading section 301 by the feed roller provided inside the document conveying section 70. In this case, the first frame 311 and the second frame 312 are positioned at the first reading position without movement. Then, the original document G is conveyed with sliding on the first reading surface 320A by the document conveying section 70, so that the image formed on the surface of the original document G is read by the CCD 358 serving as the reading unit.

On the other hand, in the case where the document conveying section 70 is open, the original document G is placed on the second reading surface 302B. In this case, each of the first and second frames 311 and 312 moves in the sub-scanning direction X with the length of an optical path H (the optical length) to be described below kept constant. Thus, the image of the original document G placed on the second reading surface 302B is read.

In the internal space 304 of the housing 306, the plurality of mirrors 321, 322, and 323 form the optical path H allowing light from the original document G to enter the imaging lens 357. Furthermore, the first frame 311 moves at a constant speed A in the sub-scanning direction X and the second frame 312 moves at a constant speed A/2 in the sub-scanning direction X. Therefore, the length of the optical path H can be kept constant even during the image reading operation. The details of the reading section 301 will be described later.

Next, the apparatus main unit M is described.

The apparatus main unit M includes: an image forming section GK configured to form a given toner image on a paper sheet T based on given image data; and a paper feed/discharge section KH configured to feed the paper sheet T to the image forming section GK and discharge the paper sheet T having the toner image formed thereon.

The outer shape of the apparatus main unit M is defined by a case body BD serving as a housing.

As shown in FIG. 1, the image forming section GK includes: image forming units Ma, Cy, Ye, and Bk; an intermediate transfer belt 7; a secondary transfer roller 8; an opposed roller 18; and a fixing section 9.

The image forming unit Ma includes a photosensitive drum 2A serving as the image carrier (photoconductor), a charging section 10A, a laser scanner unit 4A serving as the exposure section, a developing device 16A, toner cartridge 5A, a toner supply section 6A, a drum cleaning section 11A, a static eliminator 12A and the primary transfer roller 37A.

Likewise, the image forming unit Cy includes a photosensitive drum 2B, a charging section 10B, a laser scanner unit 4B, a developing device 16B, a toner cartridge 5B, a toner supply section 6B, a drum cleaning section 11B, a static eliminator 12B, and the primary transfer roller 37B.

The image forming unit Ye includes a photosensitive drum 2C, a charging section 10C, a laser scanner unit 4C, a developing device 16C, a toner cartridge 5C, a toner supply section 6C, a drum cleaning section 11C, a static eliminator 12C, and the primary transfer roller 37C.

The image forming unit Bk includes a photosensitive drum 2D, a charging section 10D, a laser scanner unit 4D, a developing device 16D, a toner cartridge 5D, a toner supply section 6D, a drum cleaning section 11D, a static eliminator 12D, and the primary transfer roller 37D.

As shown in FIG. 1, the paper feed/discharge section KH includes two paper feed cassettes 52, a manual paper feed section 64, a conveyance path L for paper sheets T, a registration roller pair 80, a first paper discharge section 50A, and a second paper discharge section 50B. The conveyance path L, as will be described later, is a collection of a first conveyance path L1, a second conveyance path L2, a third conveyance path L3, a manual feed conveyance path LA, a return conveyance path LB, and a post-processing conveyance path LC.

The structures of the image forming section GK and the paper feed/discharge section KH are described below in detail.

First, the image forming section GK is described. In the image forming section GK, the following operations are performed in order from upstream to downstream along the surface of each of the photosensitive drums 2A, 2B, 2C, and 2D: charging of the charging section 10A, 10B, 10C, 10D; exposure of the laser scanner unit 4A, 4B, 4C, 4D; development of the developing device 16A, 16B, 16C, 16D; primary transfer by means of the intermediate transfer belt 7 and the primary transfer roller 37A, 37B, 37C, 37D; static elimination of the static eliminator 12A, 12B, 12C, 12D; and cleaning of the drum cleaning section 11A, 11B, 11C, 11D.

In addition to the above operations, the image forming section GK performs secondary transfer by means of the intermediate transfer belt 7, the secondary transfer roller 8, and the opposed roller 18 and fixing of the fixing section 9.

Each photosensitive drum 2A, 2B, 2C, 2D is formed of a cylindrical member and functions as a photoconductor or an image carrier. Each photosensitive drum 2A, 2B, 2C, 2D is disposed rotatably in the direction of the arrow about the axis of rotation extending in a direction orthogonal to a direction of travel of the intermediate transfer belt 7. An electrostatic latent image can be formed on the surface of each photosensitive drum 2A, 2B, 2C, 2D.

The charging sections 10A, 10B, 10C, and 10D are disposed facing the surfaces of the photosensitive drums 2A, 2B, 2C, and 2D, respectively. The charging sections 10A, 10B, 10C, and 10D uniformly charge the surfaces of the photosensitive drums 2A, 2B, 2C, and 2D, respectively, negatively (to give a negative polarity) or positively (to give a positive polarity). Upon application of a charging bias as will be described later, each charging section 10A, 10B, 10C, 10D charges the surface of the associated photosensitive drum 2A, 2B, 2C, 2D.

The laser scanner units 4A, 4B, 4C, and 4D function as the exposure sections and are disposed apart from the surfaces of the photosensitive drums 2A, 2B, 2C, and 2D, respectively. Each of the laser scanner units 4A, 4B, 4C, and 4D includes an unshown laser source, a polygon mirror, a motor for driving the polygon mirror, and so on.

The laser scanner units 4A, 4B, 4C, and 4D scan-expose the surfaces of the photosensitive drums 2A, 2B, 2C, and 2D, respectively, to light based on image data about the image read by the reading section 301. By the scan-exposure of the laser scanning units 4A, 4B, 4C, and 4D, charges on the exposed portions of the surfaces of the photosensitive drums 2A, 2B, 2C, and 2D are removed. Thus, an electrostatic latent image is formed on each of the surfaces of the photosensitive drums 2A, 2B, 2C, and 2D.

The developing devices 16A, 16B, 16C, and 16D are provided in association with the photosensitive drums 2A, 2B, 2C, and 2D, respectively, and disposed facing the surfaces of the photosensitive drums 2A, 2B, 2C, and 2D, respectively. The developing devices 16A, 16B, 16C, and 16D cause different color toners to adhere to the respective electrostatic latent images formed on the associated photosensitive drums 2A, 2B, 2C, and 2D to thereby form different color toner images on the surfaces of the photosensitive drums 2A, 2B, 2C, and 2D, respectively. The developing devices 16A, 16B, 16C, and 16D are associated with four different colors, i.e., yellow, cyan, magenta, and black, respectively. Each developing device 16A, 16B, 16C, 16D includes a developing roller disposed facing the surface of the associated photosensitive drum 2A, 2B, 2C, 2D; an agitating roller for use in agitating toner; and so on.

The toner cartridges 5A, 5B, 5C, and 5D are provided in association with the developing devices 16A, 16B, 16C, and 16D, respectively, and configured to contain the different color toners to be supplied to the developing devices 16A, 16B, 16C, and 16D, respectively. The toner cartridges 5A, 5B, 5C, and 5D contain yellow, cyan, magenta, and black toners, respectively.

The toner supply sections 6A, 6B, 6C, and 6D are provided in association with the toner cartridges 5A, 5B, 5C, and 5D, respectively, as well as with the developing devices 16A, 16B, 16C, and 16D, respectively, and configured to supply the respective different color toners contained in the toner cartridges 5A, 5B, 5C, and 5D to the developing devices 16A, 16B, 16C, and 16D, respectively. The toner supply sections 6A, 6B, 6C, and 6D are connected to the developing devices 16A, 16B, 16C, and 16D, respectively, each via an unshown toner supply passage.

The different color toner images formed on the photosensitive drums 2A, 2B, 2C, and 2D are sequentially primarily transferred to the intermediate transfer belt 7. The intermediate transfer belt 7 is mounted around a driven roller 35, the opposed roller 18 formed of a drive roller, a tension roller 36, and the like. The tension roller 36 urges the intermediate transfer belt 7 from the inside toward the outside, so that a given tension is applied to the intermediate transfer belt 7.

The primary transfer rollers 37A, 37B, 37C, and 37D are disposed opposite and facing the photosensitive drums 2A, 2B, 2C, and 2D, respectively, with the intermediate transfer belt 7 in between.

Given portions of the intermediate transfer belt 7 are nipped, one by each of the associated pairs of primary transfer rollers 37A, 37B, 37C, 37D and photosensitive drums 2A, 2B, 2C, 2D. The nipped given portions are pressed against the respective surfaces of the photosensitive drums 2A, 2B, 2C, and 2D. Thus, primary transfer nips N1A, NIB, N1C, and N1D are formed, one between each of the associated pairs of photosensitive drums 2A, 2B, 2C, 2D and primary transfer rollers 37A, 37B, 37C, 37D. At the primary transfer nips N1A, N1B, N1C, and N1D, the different color toner images developed on the photosensitive drums 2A, 2B, 2C, and 2D are sequentially primarily transferred to the intermediate transfer belt 7. Thus, a full-color toner image is formed on the intermediate transfer belt 7.

The primary transfer rollers 37A, 37B, 37C, and 37D are provided, together with a single or corresponding number of unshown primary transfer bias application sections. The single or corresponding number of primary transfer bias application sections apply, to each of the associated primary transfer rollers 37A, 37B, 37C, and 37D, a primary transfer bias for transferring each of the different color toner images formed on the photosensitive drums 2A, 2B, 2C, and 2D to the intermediate transfer belt 7.

The static eliminators 12A, 12B, 12C, and 12D as the static eliminating sections are disposed facing the surfaces of the photosensitive drums 2A, 2B, 2C, and 2D, respectively. Upon application of a static eliminating bias, each static eliminator 12A, 12B, 12C, 12D eliminates static charge of the charged, associated photosensitive drum 2A, 2B, 2C, 2D. Specifically, the static eliminators 12A, 12B, 12C, and 12D irradiate the surfaces of the photosensitive drums 2A, 2B, 2C, and 2D having undergone the primary transfer with light to eliminate static charge (remove residual charge) from the surfaces of the photosensitive drums 2A, 2B, 2C, and 2D, respectively.

The drum cleaning sections 11A, 11B, 11C, and 11D are disposed facing the surfaces of the photosensitive drums 2A, 2B, 2C, and 2D, respectively. The drum cleaning sections 11A, 11B, 11C, and 11D remove residual toners and deposits remaining on the surfaces of the photosensitive drums 2A, 2B, 2C, and 2D, respectively, and convey the removed toners and so on to a designated collecting mechanism to allow the collecting mechanism to collect them.

The secondary transfer roller 8 secondarily transfers the full-color toner image primarily transferred to the intermediate transfer belt 7 to the paper sheet T. An unshown secondary transfer bias application section applies to the secondary transfer roller 8 a secondary transfer bias for transferring the full-color toner image formed on the intermediate transfer belt 7 to the paper sheet T.

The secondary transfer roller 8 abuts against and separates from the intermediate transfer belt 7. Specifically, the secondary transfer roller 8 is configured to be movable between an abutment position in which it abuts against the intermediate transfer belt 7 and a non-abutment position in which it separates from the intermediate transfer belt 7. More specifically, the secondary transfer roller 8 is located in the abutment position during secondary transfer of the full-color toner image primarily transferred to the surface of the intermediate transfer belt 7 to the paper sheet 7 or otherwise located in the non-abutment position.

The opposed roller 18 is disposed on the opposite side of the intermediate transfer belt 7 to the secondary transfer roller 8. A given portion of the intermediate transfer belt 7 is nipped by the secondary transfer roller 8 and the opposed roller 18. Furthermore, the paper sheet T is pressed against the outside surface of the intermediate transfer belt 7 (the surface thereof to which the toner image has been primarily transferred). Thus, a secondary transfer nip N2 is formed between the intermediate transfer belt 7 and the secondary transfer roller 8. At the secondary transfer nip N2, the full-color toner image primarily transferred to the intermediate transfer belt 7 is secondarily transferred to the paper sheet T.

The fixing section 9 melts and presses the different color toners forming the toner image secondarily transferred to the paper sheet T to fix them on the paper sheet T. The fixing section 9 includes a heat rotor 9A capable of being heated by a heater; and a pressure rotor 9B capable of being pressed against the heat rotor 9A. The heat rotor 9A and the pressure rotor 9B nip the paper sheet T having the toner image secondarily transferred thereto and convey it while pressing it. When the paper sheet T is conveyed as it is nipped between the heat rotor 9A and the pressure rotor 9B, the toner transferred to the paper sheet T is melted and pressed, resulting in fixation on the paper sheet T.

Next, the paper feed/discharge section KH is described.

As shown in FIG. 1, the two paper feed cassettes 52 capable of containing paper sheets T are disposed one above the other in a lower part of the apparatus main unit M. Each paper feed cassette 52 is configured to be capable of being pulled out horizontally from the housing of the apparatus main unit M. Each paper feed cassette 52 is equipped with a loading plate 60 on which paper sheets T are to be placed. Each paper feed cassette 52 can contain the paper sheets T stacked on the loading plate 60. The paper sheets T placed on the loading plate 60 are fed to the conveyance path L by a cassette paper feed section 51 disposed at an end of the paper feed cassette 52 located on the paper feed side (the left end thereof in FIG. 1). The cassette paper feed section 51 includes a multi-feed prevention mechanism composed of a forward feed roller 61 configured to pick up the paper sheets T on the loading plate 60 and a paper feed roller pair 63 configured to feed the paper sheets T one by one to the conveyance path L.

The manual paper feed section 64 is provided at the right side surface of the apparatus main unit M (on the right side thereof in FIG. 1). The manual paper feed section 64 is provided mainly to feed to the apparatus main unit M paper sheets T of different size or different type from the paper sheets T set in the paper feed cassettes 52. The manual paper feed section 64 includes: a manual feed tray 65 forming a portion of the right side surface of the apparatus main unit M when closed; and a paper feed roller 66. The manual feed tray 65 is attached at its lower end to the apparatus main unit M in the vicinity of the paper feed roller 66 in a pivotable (openable and closable) manner. A single or a plurality of paper sheets T can be placed on the manual feed tray 65 in an open state. The paper feed roller 66 feeds to a manual feed conveyance path LA the paper sheets T placed on the manual feed tray 65 in an open state.

The first paper discharge section 50A and the second paper discharge section 50B are provided in an upper portion of the apparatus main unit M. The first and second paper discharge sections 50A and 50B are configured to discharge the paper sheet T to the outside of the apparatus main unit M. The details of the first and second paper discharge sections 50A and 50B will be described later.

The conveyance path L for the conveyance of the paper sheet T includes: a first conveyance path L1 from the cassette paper feed section 51 to the secondary transfer nip N2; a second conveyance path L2 from the secondary transfer nip N2 to the fixing section 9; a third conveyance path L3 from the fixing section 9 to the first paper discharge section 50A; a manual feed conveyance path LA for use in letting the paper sheet T fed from the manual paper feed section 64 flow into the first conveyance path L1; a return conveyance path LB for use in reversing the side of the paper sheet T conveyed along the third conveyance path L3 from upstream to downstream and returning to the first conveyance path L1; and a post-processing conveyance path LC along which the paper sheet T having conveyed along the third conveyance path L3 from upstream to downstream is to be conveyed to a post-processing device (not shown) connected to the second paper discharging section 50B.

Furthermore, a first junction P1 and a second junction P2 are provided halfway through the first conveyance path L1. A first bifurcation Q1 is provided halfway through the third conveyance path L3.

The first junction P1 is a junction at which the manual feed conveyance path LA joins the first conveyance path L1. The second junction P2 is a junction at which the return conveyance path LB joins the first conveyance path L1.

The first bifurcation Q1 is a bifurcation at which the post-processing conveyance path LC branches off from the third conveyance path L3. The first bifurcation Q1 is provided with a commuting member 58. The commuting member 58 is configured to commute (switch) the direction of conveyance of the paper sheet T taken out of the fixing section 9 between the third conveyance path L3 leading to the first paper discharge section 50A and the post-processing conveyance path LC leading to the second paper discharge section 50B.

Disposed halfway through the first conveyance path L1 (specifically, between the second junction P2 and the secondary transfer roller 8) are a sensor configured to detect the paper sheet T and the registration roller pair 80 for the correction of skew (oblique feed) of the paper sheet T and the timing control between the formation of a toner image in the image forming section GK and the conveyance of the paper sheet T. The sensor is disposed just before (upstream of) the registration roller pair 80 in the direction of conveyance of the paper sheet T. The registration roller pair 80 is a pair of rollers configured to perform the aforementioned correction and timing control based on information from a detection signal coming from the sensor and then convey the paper sheet T.

The return conveyance path LB is a conveyance path provided in order that in printing both sides of a paper sheet T, the side (unprinted side) opposite to the printed side is faced to the intermediate transfer belt 7. With the use of the return conveyance path LB, the paper sheet T conveyed from the first bifurcation Q1 toward the first or second paper discharge section 50A, 50B can be returned to the first conveyance path L1, inverted, and conveyed to the upstream side of the registration roller pair 80 located upstream of the secondary transfer roller 8. Then, at the secondary transfer nip N2, a given toner image is transferred to the unprinted side of the paper sheet T inverted by the return conveyance path LB.

The first paper discharge section 50A is provided at the end of the third conveyance path L3. The first paper discharge section 50A is disposed in the upper portion of the apparatus main unit M. The first paper discharge section 50A opens toward the right surface side of the apparatus main unit M (to the right in FIG. 1, i.e., toward the manual paper feed section 64 side). The first paper discharge section 50A discharges the paper sheet T conveyed along the third conveyance path L3 to the outside of the apparatus main unit M.

A discharged sheet accumulating section M1 is formed on the opening side of the first paper discharge section 50A. The discharged sheet accumulating section M1 is formed on the top surface (outside surface) of the apparatus main unit M. The discharged sheet accumulating section M1 is a portion formed by recessing the top surface of the apparatus main unit M. Therefore, the bottom surface of the discharged sheet accumulating section M1 forms a portion of the top surface of the apparatus main unit M. Paper sheets T having given toner images formed thereon and discharged from the first paper discharge section 50A are piled up and accumulated on the discharged sheet accumulating section M1.

The second paper discharge section 50B is provided at the end of the post-processing conveyance path LC. The second paper discharge section 50B is disposed in the upper portion of the apparatus main unit M. The second paper discharge section 50B opens to the left side surface of the apparatus main unit M (to the left in FIG. 1, i.e., to the side thereof connected to the post-processing device). The second paper discharge section 50B discharges the paper sheet T conveyed along the post-processing conveyance path LC to the outside of the apparatus main unit M.

The post-processing device (not shown) is connected to the opening side of the second paper discharge section 50B. The post-processing device is a device configured to perform post-processing (such as stapling or punching) for the paper sheet discharged from the image forming apparatus (copier 1).

Sensors for the detection of a paper sheet are disposed at predetermined locations in the conveyance paths.

Next, a brief description will be given of the structure for eliminating paper jams in the first, second, and third conveyance paths L1, L2, and L3 (hereinafter, these conveyance paths are also referred to collectively as a "main conveyance path") and the return conveyance path LB.

As shown in FIG. 1, the main conveyance path L1 to L3 and the return conveyance path LB are juxtaposed near to the left side surface of the apparatus main unit M (to the left in FIG. 1) to extend mainly in the top-to-bottom direction. On the left side of the apparatus main unit M (the left side thereof in FIG. 1), a cover body 40 is provided to form a portion of the side surface of the apparatus main unit M. The cover body 40 is connected at the lower end to the apparatus main unit M through a fulcrum shaft 43. The fulcrum shaft 43 is disposed so that its axial direction extends transversely to the main conveyance path L1 to L3 and the return conveyance path LB. The cover body 40 is configured to be pivotable about the fulcrum shaft 43 between a closed position (the position shown in FIG. 1) and an open position (not shown).

The cover body 40 is composed of a first cover portion 41 pivotally connected to the apparatus main unit M on the fulcrum shaft 43 and a second cover portion 42 pivotally connected to the apparatus main unit M on the same fulcrum shaft 43. The first cover portion 41 is located nearer to the outside of the apparatus main unit M (the side surface thereof) than the second cover portion 42. In FIG. 1, the hatched portion shown by falling broken lines from top right to bottom left is the first cover portion 41 and the hatched portion shown by falling broken lines from top left to bottom right is the second cover portion 42.

In the closed position of the cover body 40, the outside wall of the first cover portion 41 forms a portion of the outside surface (side surface) of the apparatus main unit M.

Furthermore, in the closed position of the cover body 40, the inside wall of the second cover portion 42 (the side thereof facing the interior of the apparatus main unit M) forms a portion of the main conveyance path L1 to L3.

Moreover, in the closed position of the cover body 40, the inside wall of the first cover portion 41 and the outside wall of the second cover portion 42 form at least a portion of the return conveyance path LB. In other words, the return conveyance path LB is formed between the first cover portion 41 and the second cover portion 42.

Since the copier 1 of this embodiment includes the cover body 40 having the above structure, in the case of occurrence of a paper jam in the main conveyance path L1 to L3, the cover body 40 is pivotally moved from the closed position shown in FIG. 1 to the open position (not shown) to open the main conveyance path L1 to L3 to the outside, so that the paper sheet jamming in the main conveyance path L1 to L3 can be removed. On the other hand, in the case of occurrence of a paper jam in the return conveyance path LB, the cover body 40 is first pivotally moved to the open position and the second cover portion 42 is then pivotally moved about the fulcrum shaft 43 toward the apparatus main unit M (to the right in FIG. 1) to open the return conveyance path LB to the outside, so that the paper sheet jamming in the return conveyance path LB can be removed.

Figure 2:
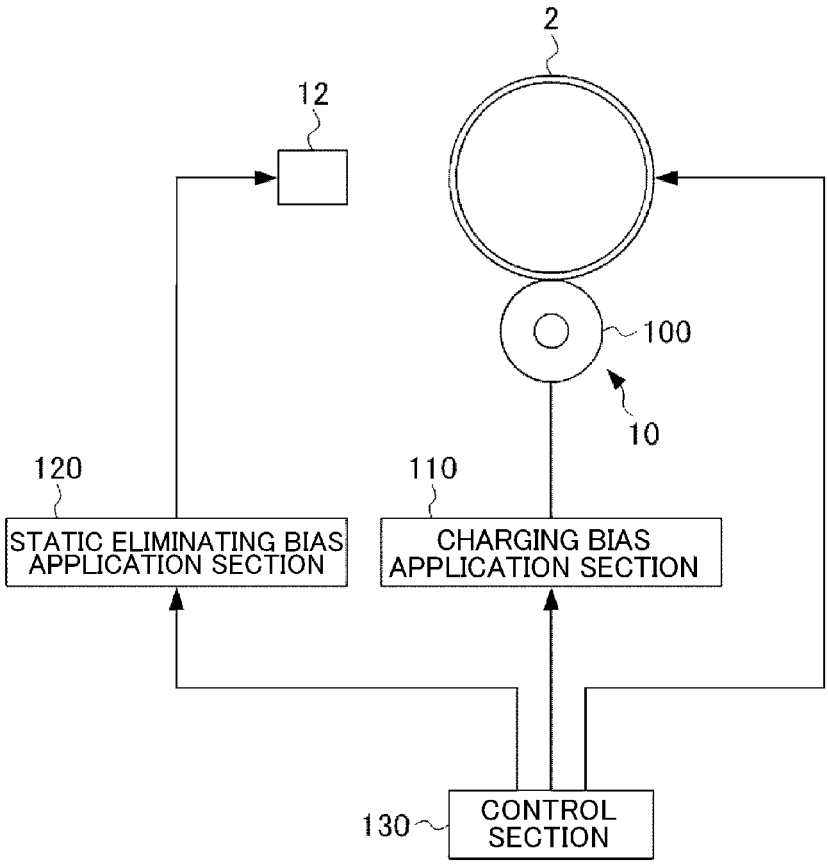
FIG. 2 is a block diagram for illustrating features of the copier according to the above embodiment.

Next, a description will be given of a bias control in the copier 1 of this embodiment and a configuration for the bias control. FIG. 2 is a block diagram showing a configuration for performing the bias control in the copier 1. FIG. 3 is a table showing an example of a relationship among the number of revolutions of the photosensitive drum, the amount of static eliminating light, and the charging bias level.

Hereinafter, the photosensitive drums 2A, 2B, 2C, and 2D are referred to collectively as a photosensitive drum 2. Likewise, the charging sections 10A, 10B, 10C, and 10D are referred to collectively as a charging section 10. Likewise, the static eliminators 12A, 12B, 12C, and 12D are referred to collectively as a static eliminator 12.

The copier 1 further includes, in addition to the above components, a charging bias application section 110, a static eliminating bias application section 120, and a control section 130. The photosensitive drum 2 is provided with an unshown drive motor and can be rotated by a rotary driving force supplied from the drive motor. The drive motor operates under the control of the control section 130.

The charging bias application section 110 is configured to apply a charging bias to the charging section 10. In a specific example, the charging bias application section 110 applies a charging bias to a charging member 100 which is a component of the charging section 10. The charging member 100 is disposed in contact with or close to the surface of the photosensitive drum 2. In the case where the charging member 100 is disposed close to the surface of the photosensitive drum 2, the charging member 100 is located approximately 50 to 100 μm away from the photosensitive drum 2. The charging member 100 is formed of, for example, a charging roller or a charging brush. Upon application of a charging bias, the charging section 10 (charging member 100) charges the surface of the photosensitive drum 2 to a potential corresponding to the bias value of the charging bias.

The static eliminating bias application section 120 is configured to apply a static eliminating bias to the static eliminator 12. Upon application of a static eliminating bias, the static eliminator 12 irradiates the photosensitive drum 2 with an amount of light corresponding to the bias value of the static eliminating bias.

The control section 130 controls, for example, the photosensitive drum 2, the charging bias application section 110, and the static eliminating bias application section 120.

Specifically, in the case where the photosensitive drum(s) 2 of any of the image forming units Ma, Cy, Ye, and Bk are rotated without the formation of electrostatic latent images on the surface(s) thereof, a bias control is performed in a manner described below.

This case includes, for example, (1) a first case where in forming a black-and-white image the control section 130 allows only the image forming unit Bk to form a toner image for the formation of the image but does not allow the other image forming units Ma, Cy, and Ye to form toner images and rotates the photosensitive drums 2 of the image forming units Ma, Cy, Ye, and Bk; and (2) a second case of preparatory rotation of the photosensitive drums 2 of the image forming units Ma, Cy, Ye, and Bk by a predetermined number of revolutions from the start of rotation till when the control section 130 allows the image forming units Ma, Cy, Ye, and Bk to start to form toner images.

For example, even in a situation where only the image forming unit Bk forms an image on a paper sheet T using a black toner, the photosensitive drums 2 associated with cyan, magenta, and yellow toners rotate. The first case is the case where in this situation the photosensitive drums 2 associated with cyan, magenta, and yellow toners rotate. The second case is the case where aging is performed before the image forming section GK forms an image.

The control section 130 controls the charging bias application section 110 as a part of a bias control to apply to the charging section 10 a predetermined charging bias smaller than a charging bias (a normal charging bias) to be applied during an image formation in which an electrostatic latent image is formed on the surface of the photosensitive drum 2. Specifically, the control section 130 controls the charging bias application section 110 to apply to the charging section 10, for example, a charging bias about 20% to about 50% smaller than the normal charging bias. The value of about 20% to about 50% is appropriately changed depending upon the structure and the like of the copier 1.

Furthermore, the control section 130 controls the static eliminating bias application section 120 as another part of the bias control to apply to the static eliminator 12 a predetermined static eliminating bias smaller than a static eliminating bias (a normal static eliminating bias) to be applied during the image formation. In other words, depending upon the reduced charging bias, the control section 130 concurrently reduces the static eliminating bias. Specifically, the control section 130 controls the static eliminating bias application section 120 to apply to the static eliminator 12, for example, a static eliminating bias about 20% to about 50% smaller than the normal static eliminating bias. The value of about 20% to about 50% is appropriately changed depending upon the structure and the like of the copier 1.

During the bias control, the control section 130 controls the charging bias application section 110 and the static eliminating bias application section 120 to increase the value of the charging bias and the value of the static eliminating bias, respectively, every one revolution of the photosensitive drum 2. Thus, finally, the values of the charging bias and the static eliminating bias reach the values during the formation of a toner image in the image formation process. By way of example, in a modified FS-05300DN manufactured by KYOCERA Document Solutions Inc., the relationship among the number of revolutions of the photosensitive drum 2, the amount of static eliminating light, and the charging bias level is as shown in FIG. 3.

More specifically, during the first revolution of the photosensitive drum 2, the control section 130 controls the static eliminating bias application section 120 to apply to the static eliminator 12 such a static eliminating bias that the amount of light applied from the static eliminator 12 to the photosensitive drum 2 (the amount of static eliminating light) will be 50% smaller than the normal amount of light. The normal amount of light is the amount of light to be applied from the static eliminator 12 to the photosensitive drum 2 when the normal static eliminating bias has been applied to the static eliminator 12. Furthermore, during the first revolution of the photosensitive drum 2, the control section 130 controls the charging bias application section 110 to apply to the charging section 10 a charging bias 500 V smaller than the normal charging bias.

During the second revolution of the photosensitive drum 2, the control section 130 controls the static eliminating bias application section 120 to apply to the static eliminator 12 such a static eliminating bias that the amount of light applied from the static eliminator 12 to the photosensitive drum 2 (the amount of static eliminating light) will be 30% smaller than the normal amount of light. Furthermore, during the second revolution of the photosensitive drum 2, the control section 130 controls the charging bias application section 110 to apply to the charging section 10 a charging bias 300 V smaller than the normal charging bias.

During the third revolution of the photosensitive drum 2, the control section 130 controls the static eliminating bias application section 120 to apply to the static eliminator 12 such a static eliminating bias that the amount of light applied from the static eliminator 12 to the photosensitive drum 2 (the amount of static eliminating light) will be equal to the normal amount of light. Furthermore, during the third revolution of the photosensitive drum 2, the control section 130 controls the charging bias application section 110 to apply the normal charging bias to the charging section 10.

For example, if, with the photosensitive drum rotating as its surface is uncharged, the normal charging bias is applied to the charging section to charge the surface of the photosensitive drum, the photosensitive drum and the like will contain a large number of carrier electron pairs. Therefore, the charging bias may show an overshoot to electrically break down the photosensitive drum. In contrast, in this embodiment, the control section 130 performs the bias control by, as described previously, beginning the charging and static elimination with the predetermined small values of charging bias and static eliminating bias and then stepwise increasing the values of charging bias and static eliminating bias with increasing number of revolutions of the photosensitive drum 2 until the values of charging bias and static eliminating bias for use during the formation of a toner image are reached. Thus, the copier 1 can prevent the charging bias from showing an overshoot and thus prevent the photosensitive drum 2 from electrically breaking down.

Figure 4:
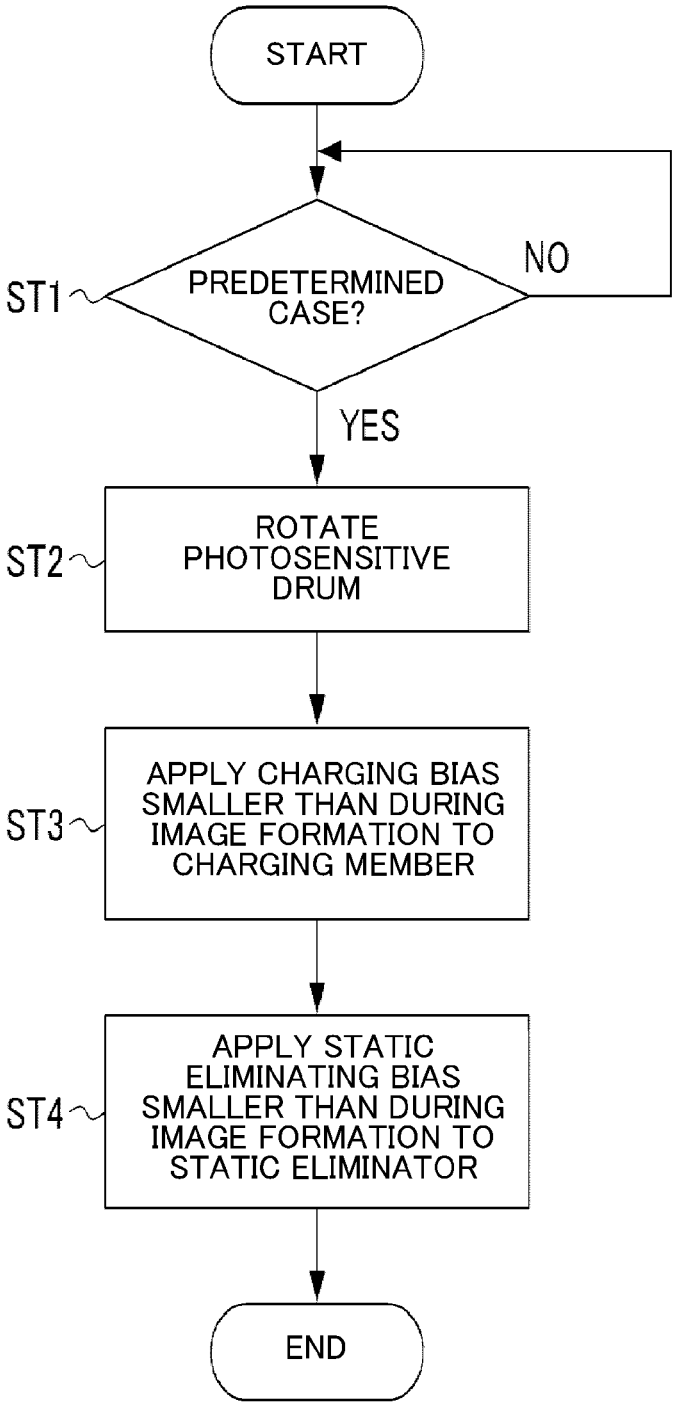
FIG. 4 is a flowchart showing a bias control of the copier.

Next, a description will be given of the bias control of the copier 1 of this embodiment. FIG. 4 is a flowchart showing the bias control of the copier 1.

In step ST1, the control section 130 determines whether or not this situation is the aforementioned predetermined case where the photosensitive drum 2 is rotated without forming an electrostatic latent image. If this situation is the predetermined case (YES in step ST1), the control section 130 operates the drive motor to rotate the photosensitive drum 2 (step ST2). If this situation is not the predetermined case (NO in step ST1), the control section 130 repeats the determination in step ST1.

In step ST3 following step ST2, the control section 130 applies a charging bias smaller than during the formation of an image to the charging section 10 (charging member 100). In step ST4, the control section 130 applies a static eliminating bias smaller than during the formation of an image to the static eliminator 12. The order of execution between steps ST3 and ST4 is not limited to the above processing example and these steps may be executed in reverse order or concurrently.

The control section 130 executes the processing of steps ST3 and ST4 to, as described previously, increase the values of charging bias and static eliminating bias every one revolution of the photosensitive drum 2 until the value of charging bias for use in charging and the value of static eliminating bias for use in static elimination finally reach the values of charging bias and static eliminating bias for use during the formation of a toner image. At this point of time when the values for use during the formation of a toner image are reached, the photosensitive drum 2 becomes capable of forming an image (a toner image).

FIG. 5 is a table for illustrating results of a comparative experiment made using a copier 1 of Example and copiers of Comparative Examples 1 and 2. In the experiment, the photosensitive drum 2 of each copier was first rotated as it was uncharged and then charged for the formation of an image and the image was formed (printed) on a paper sheet T. This process was continued until the photosensitive drum 2 electrically broke down in order to examine how many printed paper sheets it takes for the photosensitive drum 2 to electrically break down. The symbol "o" shown in FIG. 5 indicates that no electric breakdown occurred. The symbol "x" shown in FIG. 5 indicates that an electric breakdown occurred.

For the copier 1 of Example, although the aforementioned bias control was performed (Weak Charging ON, Weak Static Elimination ON) in the above predetermined case, i.e., after the photosensitive drum 2 was rotated as it was uncharged, no electric breakdown occurred even when the cumulative number of printed paper sheets reached 230 k (230,000).

On the other hand, for the copier of Comparative Example 1, when in the predetermined case a charging bias equal to the normal charging bias was applied from the charging bias application section to the charging section and a static eliminating bias equal to the normal static eliminating bias was applied from the static eliminating bias application section to the static eliminator (Charging ON, Static Elimination ON), an electric breakdown occurred by the time when the cumulative number of printed paper sheets reached 220 k (220,000). For the copier of Comparative Example 2, when in the predetermined case a charging bias smaller than the normal charging bias was applied from the charging bias application section to the charging section and a static eliminating bias equal to the normal static eliminating bias was applied from the static eliminating bias application section to the static eliminator (Weak Charging ON, Static Elimination ON), an electric breakdown occurred by the time when the cumulative number of printed paper sheets reached 230 k (230,000).

After the photosensitive drum 2 is subjected to repetitive loads due to repetition of a process from charging to primary transfer, its surface is reduced in thickness, so that it tends to increase the electrification current. In Comparative Examples 1 and 2, it can be considered that when the photosensitive drum was first rotated as it was uncharged and then charged for the formation of an image, the amount of overshoot current of the electrification current increased. Therefore, in Comparative Examples 1 and 2, the probability of occurrence of electric breakdown became high, leading to the above results. However, the results shown in FIG. 5 reveal that even when the photosensitive drum is first rotated as it is uncharged and then charged for the formation of an image, the copier 1 of this embodiment (Example) is highly effective at preventing an electric breakdown from occurring in the photosensitive drum 2.

As thus far described, the copier 1 of this embodiment exerts the following effects.

In the above predetermined case, the copier 1 of this embodiment applies a charging bias having a predetermined bias value smaller than the normal charging bias to the charging section 10 and applies a static eliminating bias having a predetermined bias value smaller than the normal static eliminating bias to the static eliminator 12.

Thus, when a job to form an image is generated after the photosensitive drum is rotated as it is uncharged, the copier 1 can immediately start the operation for forming the image on a paper sheet T while avoiding the occurrence of electric breakdown in the photosensitive drum 2 due to generation of inrush current, without having to repeat charging and static elimination from the time of generation of the job in order to recover the charging performance of the photosensitive drum.

The present disclosure is not limited by the aforementioned embodiment and can be implemented in various forms.

Although the copier 1 of this embodiment is a color copier, it is not limited to this type and may be a black-and-white copier.

Although the copier 1 of this embodiment transfers a toner image to a paper sheet T through the intermediate transfer belt 7 (by an indirect transfer method), the copier is not limited to this transfer method and may transfer the toner image formed on the photosensitive drum directly to the paper sheet T (by a direct transfer method).

Although the copier 1 of this embodiment is configured to print both sides of a paper sheet T, it is not limited to this configuration and may be configured to print a single side of a paper sheet.

The image forming apparatus according to the present disclosure is not limited to the copier 1 as described above. Specifically, the image forming apparatus according to the present disclosure may be a multifunction peripheral having a copy function, a facsimile function, a print function, and a scan function, a facsimile machine or a printer.

The sheet material for use in image transfer, on which a toner image is to be fixed by the image forming apparatus according to the present disclosure, is not limited to a paper sheet T and may be a film sheet, such as an overhead projector (OHP) sheet.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus including:

an image forming unit including an image carrier capable of being driven into rotation, a charging section configured to, upon application of a charging bias thereto, charge a surface of the image carrier being driven into rotation, an exposure section configured to expose the surface of the image carrier charged by the charging section to light to form an electrostatic latent image on the surface of the image carrier, a developing section configured to supply toner to the electrostatic latent image formed on the surface of the image carrier by the exposure section to form a toner image thereon, a transfer section configured to transfer the toner image formed by the developing section to a recording medium, a static eliminating section configured to, upon application of a static eliminating bias thereto, eliminate static charge of the charged image carrier;

a charging bias application section configured to apply the charging bias to the charging section;

a static eliminating bias application section configured to apply a static eliminating bias to the static eliminating section; and a control section configured to control an operation of the image forming unit, wherein in the case where the toner image is not forming and also where the image forming unit causes the image carrier to be rotated without forming the electrostatic latent image on the surface of the image carrier, the control section performs a bias control to allow the charging bias application section to apply to the charging section a predetermined charging bias smaller than a charging bias to be applied in forming the electrostatic latent image on the surface of the image carrier and then forming the toner image, allow the static eliminating bias application section to apply to the static eliminating section a predetermined static eliminating bias smaller than a static eliminating bias to be applied in forming the toner image, and allow the charging bias application section and the static eliminating bias application section to increase a value of the charging bias and a value of the static eliminating bias, respectively, every one revolution of the image carrier until the values of the charging bias and the static eliminating bias to be applied in forming the toner image are reached.

2. An image forming apparatus including an image forming unit including an image carrier capable of being driven into rotation, a charging section configured to, upon application of a charging bias thereto charge a surface of the image carrier being driven into rotation, an exposure section configured to expose the surface of the image carrier charged by the char in section to light to form an electrostatic latent image on the surface of the image carrier, a developing section configured to supply toner to the electrostatic latent image formed on the surface of the image carrier by the exposure section to form a toner image thereon, a transfer section configured to transfer the toner image formed by the developing n to a recording medium, a static eliminating section configured to, upon application of a static eliminating bias thereto eliminate static charge of the charged image carrier;

a charging bias application section configured to apply the charging bias to the charging section;

a static eliminating bias application section configured to apply a static eliminating bias to the static eliminating section; and a control section configured to control an operation of the image forming unit, wherein in the case where the image forming unit causes the image carrier to be rotated without forming the electrostatic latent image on the surface of the image carrier, the control section performs a bias control to allow the charging bias application section to apply to the charging section a predetermined charging bias smaller than a changing bias to be applied in forming the electrostatic latent image on the surface of the image carrier and then forming the toner image, allow the static eliminating bias application section to apply to the static eliminating section a redetermined static eliminating bias smaller than a static eliminating bias to be applied in forming the toner image and allow the charging bias application section and the static eliminating bias application section to increase a value of the charging bias and a value of the static eliminating bias, respectively, every one revolution of the image carrier until the values of image are reached, wherein the image forming unit includes a plurality of image forming units provided for different colors required to form a color image, and wherein when the control section allows any one of the image forming units for the different colors to form the toner image and does not allow the other image forming units to form toner images, the control section performs the bias control over the other image forming units.

3. The image forming apparatus according to claim 2, wherein when the control section allows, among the image forming units for the different colors, the image forming unit for formation of a black-and-white image to form the toner image and does not allow the other image forming units for the other colors to form toner images, the control section performs the bias control over the image forming units for the other colors.

4. The image forming apparatus according to claim 1, wherein the control section performs the bias control while the image carrier rotates a predetermined number of revolutions from a start of the rotation of the image carrier till when the control section allows the image forming unit to start to form the toner image.

* * * * *